US005447452A

United States Patent [19]

Takano

[11] Patent Number: 5,447,452

[45] Date of Patent: Sep. 5, 1995

[54] CONSOLIDATING LOCKING APPARATUS OF A CONNECTOR FRAME

[75] Inventor: Tsunesuke Takano, Tokyo, Japan

[73] Assignee: Daiichi Denso Buhin Co., Ltd., Japan

[21] Appl. No.: 251,935

[22] Filed: Jun. 1, 1994

[30] Foreign Application Priority Data

Jun. 14, 1993 [JP] Japan ..... 5-37100 U

[51] Int. Cl.[6] ..... H01R 13/502

[52] U.S. Cl. ..... 439/695; 439/696

[58] Field of Search ..... 439/695, 696, 686, 687, 439/690, 901, 904–906

[56] References Cited

U.S. PATENT DOCUMENTS 4,410,225 10/1983 Stoewe et al. ..... 439/696
5,219,304 6/1993 Lin ..... 439/696
5,252,081 10/1993 Hart ..... 439/696

FOREIGN PATENT DOCUMENTS 58-10306 2/1983 Japan .
59-187082 12/1984 Japan .
62-115681 5/1987 Japan .

*Primary Examiner*—Gary F. Paumen
*Attorney, Agent, or Firm*—Nixon & Vanderhye

[57] ABSTRACT

A consolidated locking apparatus of a connector frame includes a pair of square tray-shaped insulating frames formed from plastic. A protruding wall is provided having slits and locking flanges on and protruding from the front of each respective insulating frame. A plurality of narrow conducting strips are mounted inside of each of the insulating frames. Bent pieces unitary with and formed substantially parallel to the narrow conducting strips project to the outside of the insulating frames through these slits. An insulative, closed bottom cylinder is removably attached to the insulating frames at their protruding walls by apertures through which the bent pieces pass via locking resilient tabs of the closed bottom cylinder on the locking flanges. Base portions of the bent pieces are positioned and reinforced with peripheral surfaces of the apertures of the closed bottom cylinder.

1 Claim, 4 Drawing Sheets

CONSOLIDATING LOCKING APPARATUS OF A CONNECTOR FRAME

FIELD OF THE INVENTION

The present invention relates to a consolidating locking apparatus of a connector frame that prevents deformation or indiscriminate displacement of the bent pieces of narrow conducting strips by tightly positioning and reinforcing the protruding base portions of narrow conducting strips normally referred to as BUS bars mounted on a pair of tray-shaped insulating frames with the peripheral sides of apertures of a closed bottom insulating cylinder which consolidates and locks said pair of insulating frames.

BACKGROUND OF THE INVENTION

An example of this type of connector housing for making an electrical connection of the prior art is described in Japanese Examined Utility Model Publication No. 58-10306.

In this prior art, a connector housing is disclosed which houses a plurality of female bipolar terminals provided by fitting onto a corresponding plurality of male terminals arranged in a row. A partition wall orthogonal to side walls in the lengthwise direction is provided inside the frame body open at the top and bottom. Together with forming a plurality of terminal chambers, tapered guide surfaces are formed on the lower edges of the right and left side walls and partition wall of said frame body, thus positioning the lower end of said partition wall with the lower open end and out of alignment with the inner and outer sides of said frame body.

In the above-mentioned prior art, a housing is attached to a circuit board by screwing a separately prepared cover plate onto said circuit board with flanges formed projecting towards the bottom of said housing pushed into the periphery of apertures of said cover plate.

Thus, since a cover plate is required to be provided separately, part administration becomes difficult and the cost of the connector housing is increased. In addition, fastening of the cover plate with screws is quite laborious particularly in confined or dark locations, and a special tool such as a screw driver is required, thus resulting in a first problem of the prior art.

In this prior art in particular, since the base portion itself of the rising portion (bent piece) of a narrow circuit plate cannot be fixed with the lower surface of the housing, and the upper surface of said circuit plate separated from the base portion is pressed onto a circuit board with the bottom portion of a tapered inner surface of the flanges of said housing, said rising portion is susceptible to deformation and displacement by an external force, thus resulting in a second problem of the prior art.

In addition, as described in Japanese Laid-Open Patent Publication No. 62-115681, a joint connector is disclosed having a so-called insert forming terminal holder wherein a roughly U-shaped conducting connection piece referred to as a BUS bar is molded into a single structure with an insulated BUS bar holder. In this joint connector, instead of not requiring reinforcing of pinching of the base portion of said connection piece, the above-mentioned insert forming itself requires a high degree of dimensional accuracy, thus making it complex and expensive. Moreover, since one side of the above-mentioned BUS bar is directly connected to other parts while the other side is connected with a lead wire equipped with a pin, and the electrical continuity of other parts is not mutually connected with narrow conducting strips, in the case of this example of the prior art, guiding work for the above-mentioned lead wire is complex and requires a lead clamp, thus resulting in numerous problems.

Moreover, as described in Japanese Laid-Open Utility Model Publication No. 59-187082, that which is described uses a composition combining a projecting engaging portion and an engaging aperture that receives such during mounting of a connector and so forth. This type of example of the prior art has the problem of being unable to tightly pinch and reinforce the rising base portions of narrow conducting strips between the peripheral sides of apertures and the base protruding walls of a closed bottom cylinder.

SUMMARY OF THE INVENTION

In order to eliminate each of the problems described above, the object of the present invention is to position and reinforce the protruding base portions of bent pieces of narrow conducting strips arranged on a pair of insulating frames by surrounding with the peripheral edges of bent piece insertion apertures of a closed bottom cylinder fit onto protruding walls of said insulating frames after joining those insulating frames, as well as to maintain the joined state of the above-mentioned two insulating frames with said closed bottom cylinder.

BRIEF DESCRIPTION OF THE ACCOMPANYING DRAWINGS

DETAILED DESCRIPTION OF THE PREFERRED EXEMPLARY EMBODIMENT

The following provides an explanation of the embodiments of the present invention with reference to the drawings.

Figure 1:
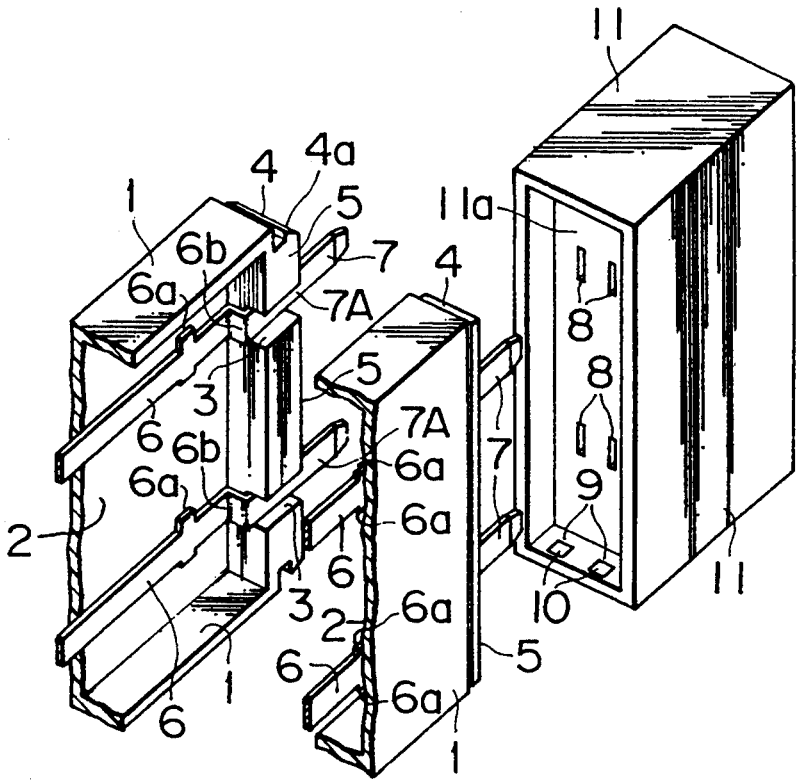
FIG. 1 is an exploded perspective view of an embodiment of the present invention.
Figure 2:
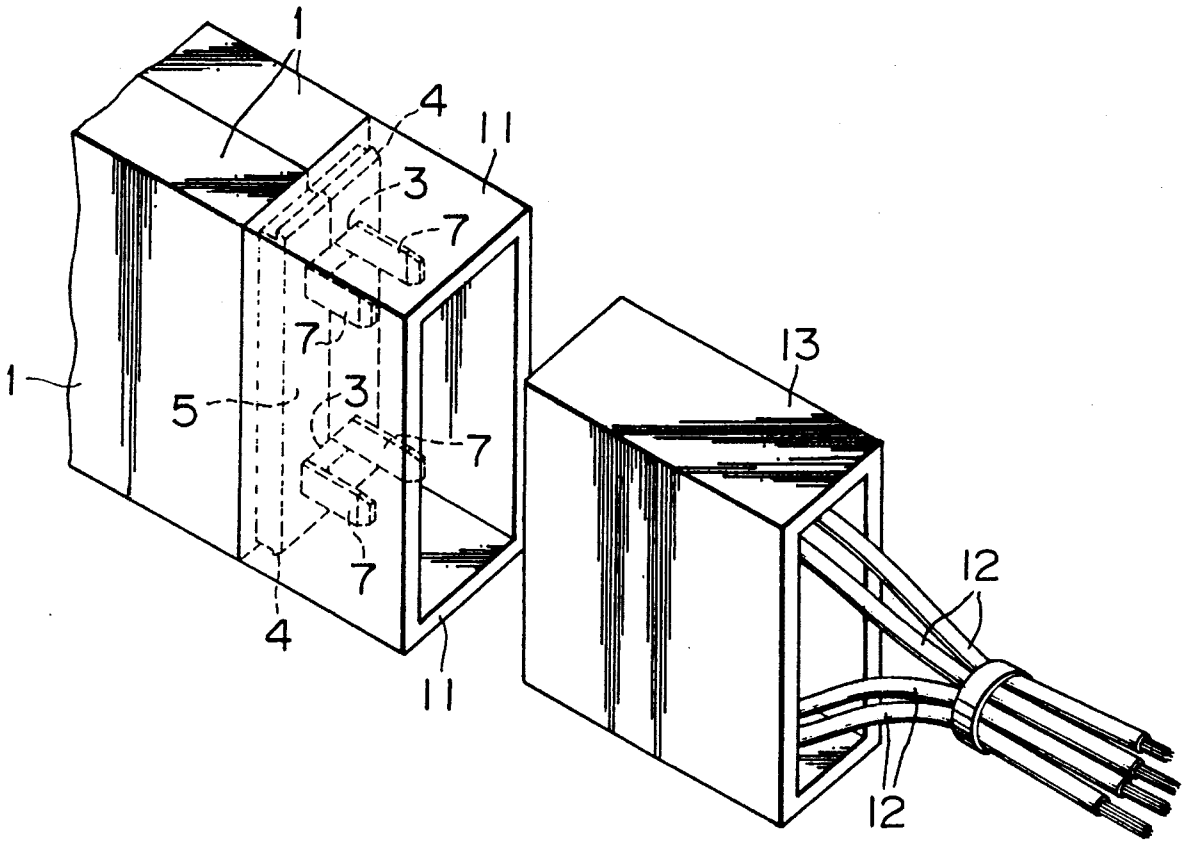
FIG. 2 is a perspective view of the above after assembly.

To begin with, as shown in FIGS. 1 and 2, the basic constitution of the present invention consists of providing a plurality of bent pieces 7, bent into the shape of the letter "Z", so as to be mutually parallel with, for example, the ends of a plurality of narrow conducting strips 6 in the form of long, narrow metal strips, mounted by a commonly known means such as adhesion by means of mounting legs **6*a* and bent portions 6*b* to inner surfaces 2 of insulating frames 1, by aligning with one of the surfaces of protruding walls 5 wherein slits 3, communicable with the inner surfaces 2 of a pair of insulating frames 1 formed into the shape of trays from plastic, and at least one hook-shaped locking flange 4, are formed; and, housing these bent pieces 7 within the slits 3 of said protruding walls 5**.

Figure 3:
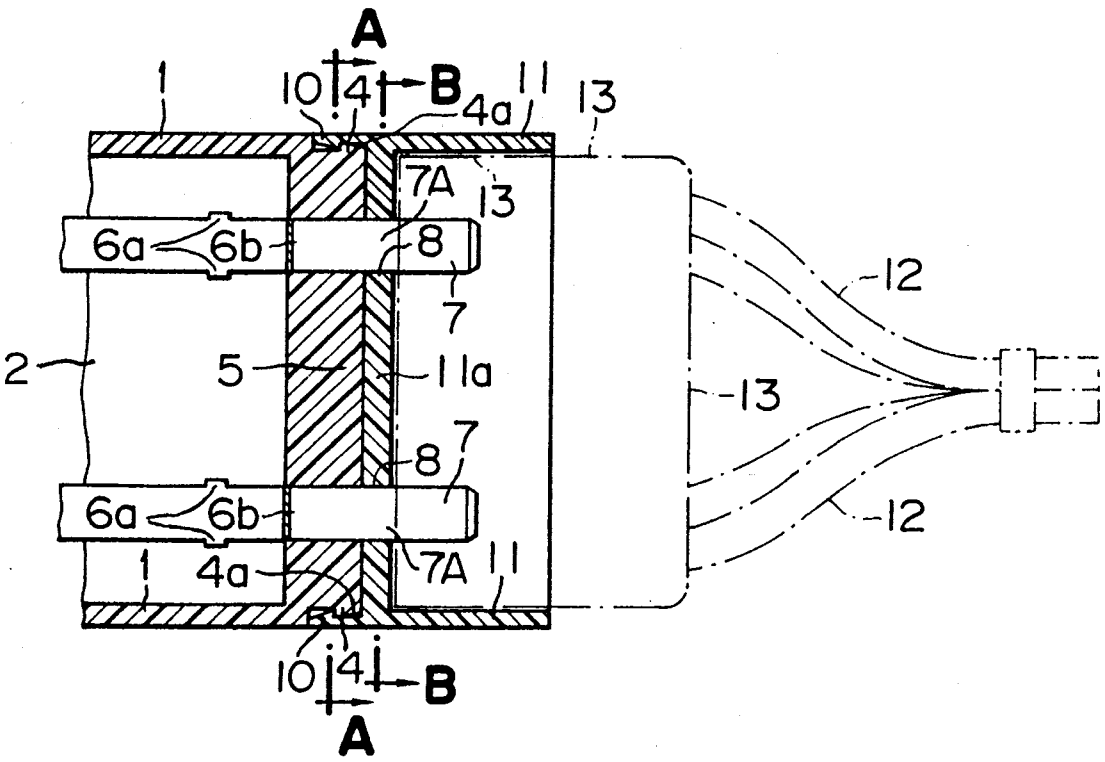
FIG. 3 is an enlarged cross-sectional view of the essential portion of that shown in FIG. 2.
Figure 4:
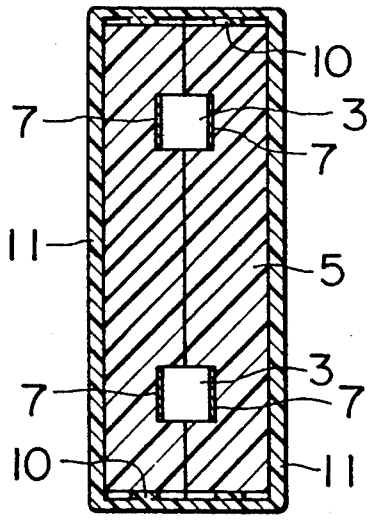
FIG. 4 is a cross-sectional view taken along line A—A of FIG. 3.

Moreover, by preparing square cylinder-shaped closed bottom cylinder 11, having insulated bottom **11*a*, wherein apertures 8 through which bent pieces 7** pass are formed as shown in FIG. 1, and resilient locking tabs 10 projecting from the upper and lower inner surfaces within the above-mentioned slits 3 via bottom 11*a*, said resilient locking tabs 10 attach to insulating frames 1 by locking onto locking flanges 4 of said insulating frame protruding walls 5 as shown in FIGS. 2 and 3.

Furthermore, insulating frames 1 and cylinder 11 are made by forming with a heat-resistant plastic such as Nylon 66.

As a result of the present invention having the constitution as described above, it can actually be used as, for example, a switch selector or switch member by inserting insulated male engaging body 13, equipped with commonly known female connection pieces to be connected by inserting onto said bent pieces 7 within closed bottom cylinder 11, into cylinder 11 by going through the state shown in FIG. 2, and connecting said narrow conducting strips 6 to a desired external location via lead wire 12 guided from the female connection pieces inserted onto said bent pieces 7.

Furthermore, although the preceding description explained the example of providing two pairs of two narrow conducting strips 6 and bent pieces 7 each, one pair or a plurality such as three or more pairs of each may be arranged in insulating frames 1. The number of apertures 8 in closed bottom cylinder 11 and the number of female connection pieces as well as the shape of male engaging body 13 and closed bottom cylinder 11 should then be selected according to that number.

Since the apparatus of the present invention has the constitution as described above, after first joining the pair of insulating frames 1 as shown in FIG. 2 from the state of being separated into three units as shown in FIG. 1, the joined insulating frames 1 are pushed onto while making contact with closed bottom cylinder 11 by aligning their protruding walls 5. Whereupon, the end surfaces of resilient locking tabs 10 resiliently engage with locking flanges 4 by entering with a clicking action as shown in FIG. 3 the inside surfaces thereof while being deflected to the outside in opposition to their resiliency by the pushing stress of locking flange tapered surfaces 4*a* of insulating frames 1 applied to their inside tapered surfaces. Closed bottom cylinder 11 can thus be attached to insulated frames 1 with a single snapping action using a so-called "snap fit" mechanism as shown in FIGS. 2 and 3.

Figure 5:
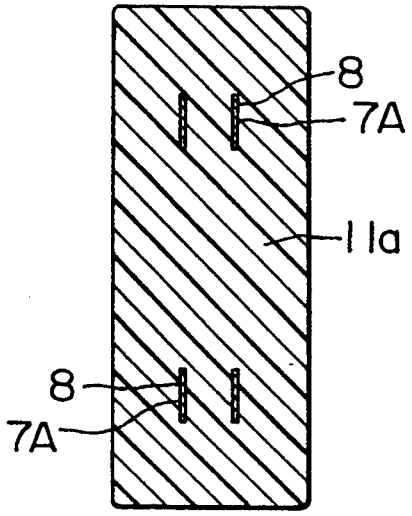
FIG. 5 is a cross-sectional view taken along line B—B of FIG. 3.

In this inserted state, as a result of base portions 7A of bent pieces 7 of narrow conducting strips (BUS bars) 6 mounted and arranged in insulating frames 1 being tightly held as shown in FIG. 5 with the peripheral sides of apertures 8 of closed bottom cylinder 11 attached to insulating frames 1 with resilient locking tabs 10 as described above, bent pieces 7 are not indiscriminately deformed or displaced by external force caused by inserting and removing female connection pieces 12.

In addition, narrow conducting strips 6 can be used connected to an external circuit via their bent pieces 7, female connection pieces and lead wires 12.

The present invention demonstrates the effects described below as a result of having the previously described constitution.

Since closed bottom cylinder 11 can be attached to the joined peripheral edges of two frame protruding walls 5 with their resilient locking tabs 10 in a single snapping action without using a cover plate or special tools, two insulating frames can be maintained in the joined state for a long time, thereby offering a first advantage of the present invention.

In addition, since protruding base portions 7A of the bent pieces of narrow conducting strips (BUS bars) 6 mounted and arranged on the inner surfaces of insulating frames are passed tightly through apertures 8 of closed bottom cylinder 11 attached to insulating frames with resilient locking tabs 10, the base portions of said bent pieces can be positioned and reinforced as a result of being tightly surrounded by the peripheral sides of those apertures 8. Thus, bent pieces 7 are safe since they are prevented from being indiscriminately deformed or displaced by external force caused by insertion and removal of female connection pieces into which they are inserted, thereby offering a second advantage of the present invention.

What is claimed is:

1. A consolidated locking apparatus of a connector frame comprising:

a pair of square tray-shaped insulating frames formed from plastic;

a protruding wall having slits and locking flanges provided on and protruding from the front of each respective insulating frame;

a plurality of narrow conducting strips mounted inside of each said insulating frame;

bent pieces unitary with and formed substantially parallel to the narrow conducting strips and projecting to the outside of the insulating frames through said slits; and an insulative, closed bottom cylinder removably attached to said insulating frames at their protruding walls by apertures through which the bent pieces pass and locking resilient locking tabs of the closed bottom cylinder on said locking flanges, wherein base portions of said bent pieces are positioned and reinforced with peripheral surfaces of said apertures of the closed bottom cylinder.

* * * * *